US005364205A

United States Patent [19]

Lemelson

[11] Patent Number: 5,364,205

[45] Date of Patent: Nov. 15, 1994

[54] METHOD AND APPARATUS FOR ROAD HOLE REPAIR

[76] Inventor: Jerome Lemelson, 868 Tyner Way, Call Box 14-286, Incline Village, Nev. 89450

[21] Appl. No.: 115,819

[22] Filed: Sep. 3, 1993

Related U.S. Application Data

[62] Division of Ser. No. 901,265, Jun. 19, 1992.

[51] Int. Cl.[5] ..... E01C 23/07

[52] U.S. Cl. ..... 404/72; 404/84.05; 404/82

[58] Field of Search ..... 404/72, 75, 84.05, 84.1, 404/84.5, 101, 102, 108, 111, 78, 82; 222/1, 52; 118/670, 713

[56] References Cited

U.S. PATENT DOCUMENTS

| | | | |
|---|---|---|---|
| 3,266,302 | 8/1966 | Spangler et al. | 73/105 |
| 3,741,334 | 6/1973 | Kaule | 73/67.9 X |
| 4,198,177 | 4/1980 | Ray, Jr. et al. | 404/75 |
| 4,236,675 | 12/1980 | Bladykas | 241/65 |
| 4,252,487 | 2/1981 | Jeppson | 404/77 |
| 4,272,212 | 6/1981 | Bauer, Jr. et al. | 404/72 |
| 4,396,942 | 8/1983 | Gates | 358/107 |
| 4,422,322 | 12/1983 | Spangler | 73/105 |
| 4,456,829 | 6/1984 | Fohey | 404/84.5 X |
| 4,473,319 | 9/1984 | Spangler | 404/84.05 X |
| 4,677,599 | 6/1987 | Obayashi et al. | 367/99 |
| 4,786,815 | 11/1988 | Walker et al. | 250/560 |
| 4,820,078 | 4/1989 | Brocious | 404/111 X |
| 4,878,598 | 11/1989 | Ruschhaupt, Jr. | 222/1 |
| 4,958,306 | 9/1990 | Powell et al. | 364/550 |
| 5,092,706 | 3/1992 | Bowen et al. | 404/77 |
| 5,131,788 | 7/1992 | Hulicsko | 404/108 |
| 5,217,320 | 6/1993 | Cioffi | 404/102 X |
| 5,236,275 | 8/1993 | Kneeland et al. | 404/75 |

FOREIGN PATENT DOCUMENTS

| | | | |
|---|---|---|---|
| 1474199 | 4/1989 | U.S.S.R. | 404/84.5 |

*Primary Examiner*—Ramon S. Britts
*Assistant Examiner*—James A. Lisehora
*Attorney, Agent, or Firm*—Louis Weinstein

[57] ABSTRACT

Automated system for pothole repair including apparatus mounted upon a vehicle for detecting the presence of a pothole and alerting and/or slowing and/or halting the vehicle responsive to such detection. Sensors measure the size of the pothole and/or monitor the filling of the pothole to automatically terminate the filling operation when completed. The sensor outputs are used to determine either level of repair material or volume thereof. The sensors and dispenser (or dispensers) are automatically moved to the desired locations. The filled cavity may be compacted and/or cured. Filler material may be selectively delivered from one or more than one dispensing nozzle.

28 Claims, 8 Drawing Sheets

METHOD AND APPARATUS FOR ROAD HOLE REPAIR

This is a division of application Ser. No. 07/901,265, filed Jun. 19, 1992.

FIELD OF THE INVENTION

The present invention relates to monitoring and filling apparatus and more particularly to apparatus for monitoring and automatically filling potholes and the like in paved surfaces.

BACKGROUND OF THE INVENTION

Potholes and the like are encountered quite frequently in paved surfaces, such as, roads, highways, driveways, parking lots and any paved surfaces which experience wear due to constant vehicular travel, temperature, weather and the like.

The conventional techniques for road surface and pothole repair necessitate a significant amount of manual activity and, in fact, is quite labor intensive. Typically, one or two operators observe the pothole to be refilled and direct the driver of the vehicle to properly position the vehicle and thereafter manually position a dispenser above the pothole, manually initiate flow, and ultimately manually terminate asphalt or resin flow once the pothole is filled. Separate tampers and/or tamping equipment is also typically utilized.

It is thus an objective of the present invention to significantly reduce the labor intensity of pothole repair and to automate the operation to the greatest practical extent.

BRIEF DESCRIPTION OF THE INVENTION

The present invention is characterized by comprising an automated mobile pothole repair system in which a suitable reservoir of the repair material, which may, for example, be molten asphalt or any fluent resin having like characteristics of ease of portability and use, the vehicle being either a self-contained motor-driven vehicle or a suitable wheel mounted carriage capable of being coupled to and moved by a truck or other suitable motor-driven vehicle.

The repair apparatus is further provided with one or a plurality of sensors operatively positioned to detect the presence of a pothole and to provide either an audible or visual signal indicating same (or both) and/or automatic slowing and/or stopping of the vehicle.

In one preferred embodiment, a plurality of scanners are selectively operated to determine the volume of the pothole whereupon dispensing of a resin filler is initiated, utilizing the coordinates established by the sensors.

In another preferred embodiment, the depth of the pothole may be monitored during filling and, when the surface of the filled resin substantially reaches the level of the paved surface, filling may be automatically halted.

In still another embodiment, the sensor (or sensors) are moved in mutually perpendicular directions (preferably sequentially) to either monitor the filling operation, or alternatively, to determine the amount of resin required to fill the pothole.

Techniques are provided for the alternative approaches toward filling and are presented in the form of flow diagrams.

Techniques are further provided for curing and/or compacting the repair material filling the pothole or other cavity or surface irregularity.

OBJECTS OF THE INVENTION

It is, therefore, a primary object of the present invention to provide a substantially fully automated pothole repair system.

Another object is to provide a novel pothole repair system in which sensors are provided to detect the presence of potholes and provide audible and/or visual alarms.

Still another object of the present invention is to provide a novel pothole repair system in which sensors are provided to automatically slow and/or stop the vehicle preparatory to a pothole repair operation.

Still another object of the present invention is to automatically cure and/or compact filler material in a repaired cavity.

Still another object of the present invention is to provide a novel automated pothole repair system in which filling of a pothole is monitored and dispensing of the repairing resin is automatically initiated and thereafter halted upon the presence of appropriate conditions which are detected by monitoring sensors.

Still another object of the present invention is to employ sensors for detecting the presence and monitoring of the filling of cavities in a road surface.

Still another object of the present invention is to employ sensors for detecting the presence and monitoring of the filling of cavities in a road surface and to position movable filler material dispensing means responsive to the scanning operation by the sensors.

The above, as well as other objects of the present invention, will become apparent when reading the accompanying description and drawings, in which:

DETAILED DESCRIPTION OF THE INVENTION AND THE PREFERRED EMBODIMENTS THEREOF

Figure 2:
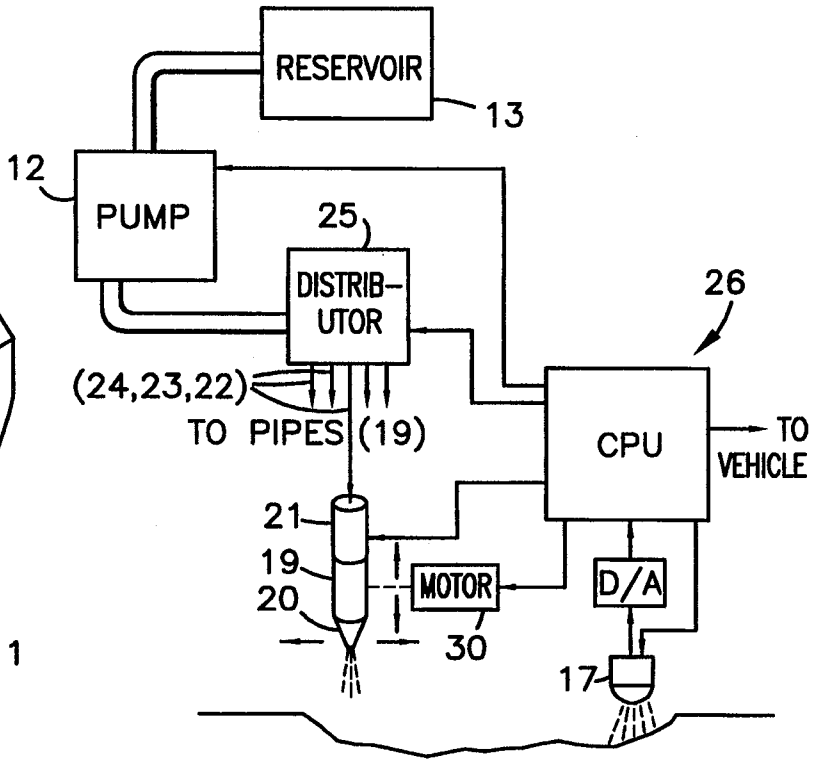
FIG. 2 shows a schematic diagram incorporating the control means for operating the system of FIG. 1.
Figure 1:
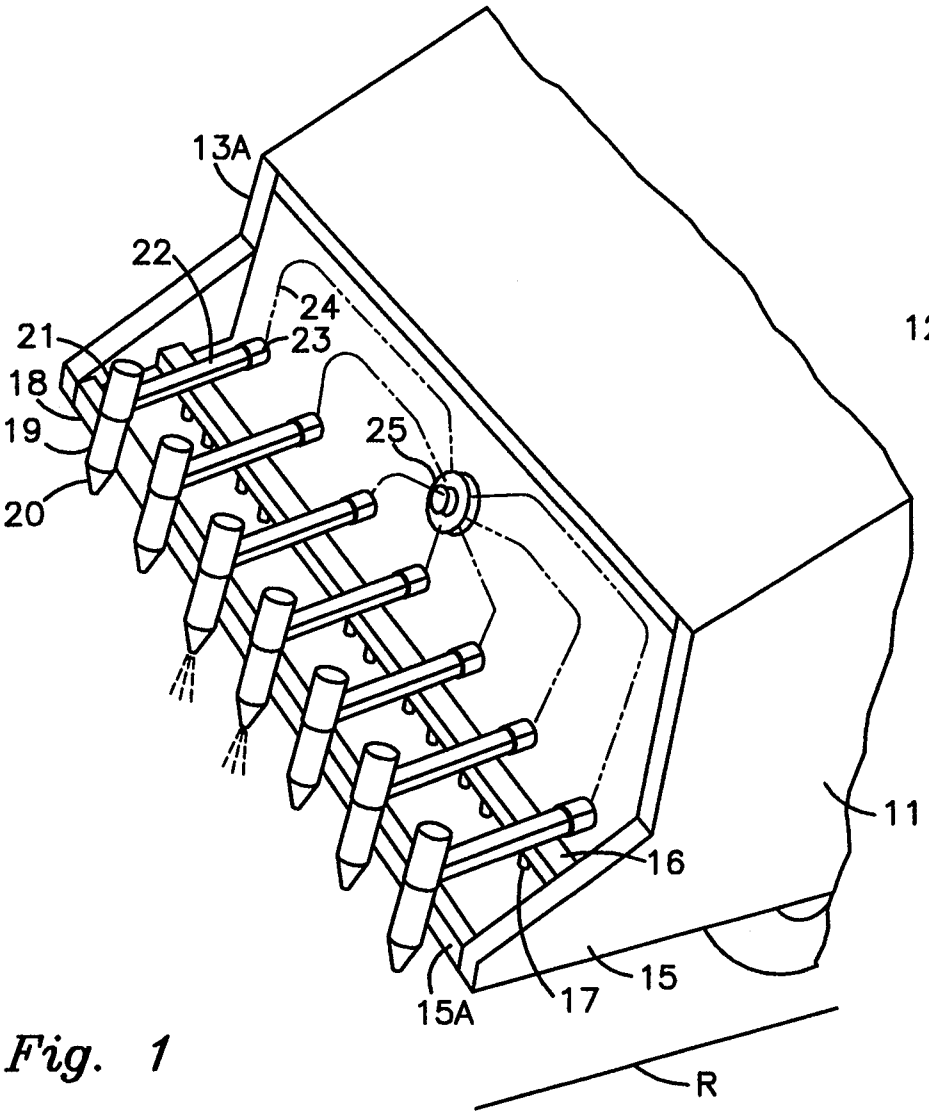
FIG. 1 is a perspective view showing a repair system embodying the principals of the present invention.

FIGS. 1 and 2 show a first embodiment 10 of the present invention comprising a wheeled mobile vehicle which may be of the self-propelled type including a truck portion (not shown for purposes of simplicity) or alternatively, capable of being coupled to and towed by a self-propelled vehicle for movement along a highway, road or other paved surface, said surface having one or more faults or cavities, such as potholes, to be filled with a filler or repair material, such as a liquid resin or mixture, such as macadam, asphalt, asphalt and crushed stone or one or more resins mixed therewith, etc. Filling may occur either while the vehicle is in motion or is halted or during periods when the vehicle is in motion and stopped.

The rear end 15 of vehicle 10 includes a frame or bar 15A extending across the rear of the vehicle and aligned lateral to the longitudinal direction thereof, and adapted to support an array of nozzles 20 preferably arranged at equi-spaced intervals (for example, six inches or less apart) one or more of the nozzles being operable to dispense a measured quantity of fluent hole or cavity filling material supplied under pressure or delivered by or under the influence of gravity from a reservoir or container 13 forming part of the vehicle body 11.

Nozzles 20 extend downwardly and their interiors communicate with a plurality of conduits 19, each of which is provided with a solenoid operated valve 21 for selectively delivering liquid filler to respective ones of the nozzles 20. Coupler fittings 23 connect each of the conduits 22 to an associated conduit 24, coupling each nozzle 20 to a distribution means 25 preferably arranged along the rear wall 13A of vehicle body 11.

The distributor 25 may have a single input, selectively feeding one or more outputs. For example, a feed screw may advance repair material along a trough or cylindrical conduit having a plurality of outlets at spaced intervals arranged laterally in the means shown in FIG. 5, each outlet being provided with a control valve (see also FIG. 9). Repair material may be advanced in an amount or at a rate sufficient to accommodate more than one open control valve, i.e. such that any one outlet dispenses repair material at a rate less than the flow rate through the conduit or trough to enable delivery of repair material to more than one open outlet at a time.

The distributor may alternatively comprise a plurality of openings at the bottom of the reservoir or container holding the repair material, each opening provided with a flow control valve. The repair material may be gravity fed. More than one of the control valves may selectively be opened at the same time depending on the extent of the cavity or pothole.

Figure 9:
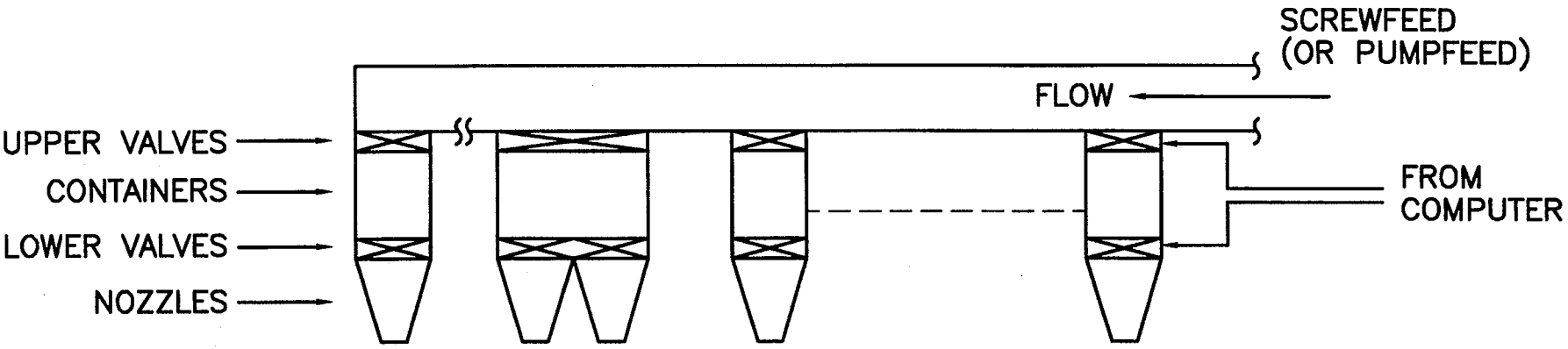
FIGS. 9 and 9*a* show simplified diagrams of an alternative filler material apparatus.

A container may be provided between each of the outlets and the nozzle (FIG. 9). An upper valve is selectively opened by the computer to fill (or partially fill) its associated container. The lower valves are selectively controlled by the computer to dispense repair material. The containers may be provided with two or more nozzles, each nozzle having an associated lower control valve. The container may be refilled if more repair material is needed to fill a large pothole. The containers contain a predetermined quantity of material in applications where a controlled amount is desirable. In applications where one nozzle is being fed, the upper and lower valves may remain open at least until the desired amount of material is dispensed.

The volume of containers C (FIG. 9*a*) may be adjusted by rotating lower container portion $C_L$ by rotating motor M to rotate spur gear $G_1$ engaging gear $G_2$ in one of two opposing directions to move container portion $C_1$ up or down relative to portion $C_2$. $C_1+C_2$ are threadedly engaged by threaded means along the inner periphery of $C_1$ and the outer periphery of $C_1$ and the outer periphery of $C_2$. An O-ring R maintains a liquid-tight sliding seal. Motor M is controlled by CPU 201, for example, (see FIG. 8). As an alternative, the gears $G_1$, $G_2$ may be a rod and pinion arrangement, gear $G_1$ serving as the pinion gear and $G_2$ being replaced by an axially aligned rack engaged by $G_1$ to move $C_1$ (joined to the rack) up and down to adjust volume. Guides may be provided to prevent $C_1$ from rotating about its longitudinal axis.

The multiple dispenser arrangements of FIGS. 1 and 9 may be employed for a variety of applications, such as:

1. Automatic road paving per se where it may be required to variably distribute asphalt or other material on an unpaved or previously paved surface depending on lateral grading and the condition of the previous worn paving.

2. Sheet or panel laminating apparatus where adhesive and/or molten or liquid resin is controllably applied to a sheet or panel surface or surfaces (using resin, adhesive or other filler material delivered by injection-molding type screw feed (or other suitable means) to select lateral locations along the surface of the base or sheet.

3. The filling of multiple injection, slush or rotational molds or concrete molds held stationary or on a conveyor. The dispenser may be lateral to or aligned with the direction of movement of the conveyor.

4. Multiple bag, can or box filling lines. Production may be doubled, tripled, or quadrupled using a single computer controlled, multi-spout filling barrel or screw with computer control of solenoid valves for each spout.

A plurality of sensors 17, preferably arranged at equi-spaced intervals along an elongated support bar 16, scan respective lateral portions of the roadway surface for detecting potholes, depressions or other surface irregularities requiring repair or filling. Initial treatment of potholes or the like is beyond the scope of the present invention. However, it is appropriate to understand that such treatment may include high pressure blowers and/or coring or digging means, supported by the vehicle 11 or another vehicle, if necessary, to prepare a pothole for filling. Such preparatory activity may be totally independent of the repair activities described herein or may be integrated therewith.

Sensors 17 may comprise any suitable type of distance measuring means such as, for example, electro-optical devices (including photo-electric surface detectors, video cameras or laser scanners), ultrasonic pulse echo transducers or any other suitable devices capable of detecting the surface, contour or topography of roadway R. The scanners may be operated simultaneously or sequentially on a time-share basis and may be moved independently of one another. Sensor signals are processed by a central electronic processor or CPU 26 for computing the locations and shapes of cavities scanned and the amount of cavity filling material required to fill each cavity, providing control signals for controlling the operation of pump 12, distributor 25 and solenoid operated valves 21 to control the amount of filler resin dispensed.

The nozzles 20 and scanners 17 may be movable and driven by suitable motors such as, for example, motor 30 driving nozzle 20 shown in FIG. 2. The nozzles 20 may be movably mounted along support 15A, conduits 22 preferably being sufficiently flexible to enable lateral movement of the nozzles.

The scanners 17, upon detecting the presence of a pothole (see FIG. 2) provide signals analyzed by CPU 26 which are utilized to control the vehicle in the form of providing an alarm signal upon detection of a pothole for either slowing the speed of the vehicle or stopping the vehicle when a pothole is detected.

Figure 3A:
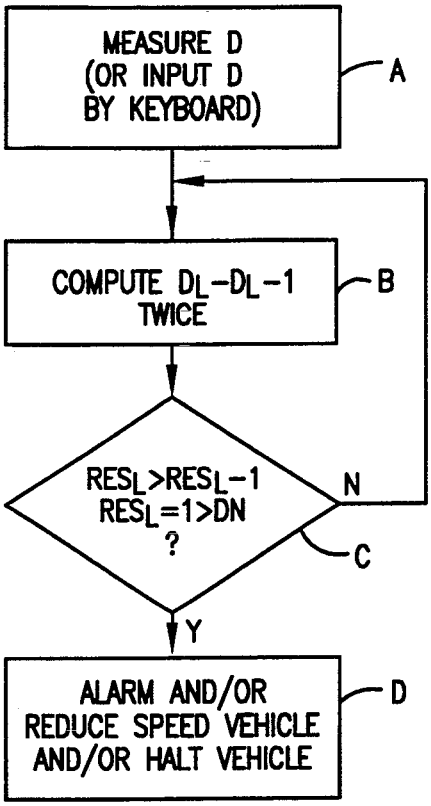
FIGS. 3*a* through 3*c* are flow diagrams useful in explaining the operation of the systems of FIGS. 1 and 2.

Noting, for example, the flow diagram of FIG. 3*a*, roadway distance from the scanner 17 is measured at step A at predetermined intervals, for example, of the order of 1,000th of a second. At a vehicle speed of 15 miles per hour, for example, measurements are taken every 0.264 inches. Each distance measurement is temporarily stored in a memory (see FIG. 8) and compared with the next distance measurement. The difference between the two measurements is stored in a memory. The steps are repeated preferably at least twice. When the last result is greater than the immediately previous result and when the immediately previous result is greater than the distance of the normal road surface which is established as the distance between the scanner and the road surface in the absence of a depression, the system provides an alarm to the vehicle operator and/or to the engine or motor controls to slow the vehicle and/or stop the vehicle. As an alternative, the distance between scanner 17 and the normal road surface may be manually inputted into memory by a keyboard input (note FIGS. 6 or 8). The inputted distance is then compared with the measured distance to control vehicle movement.

Figure 4:
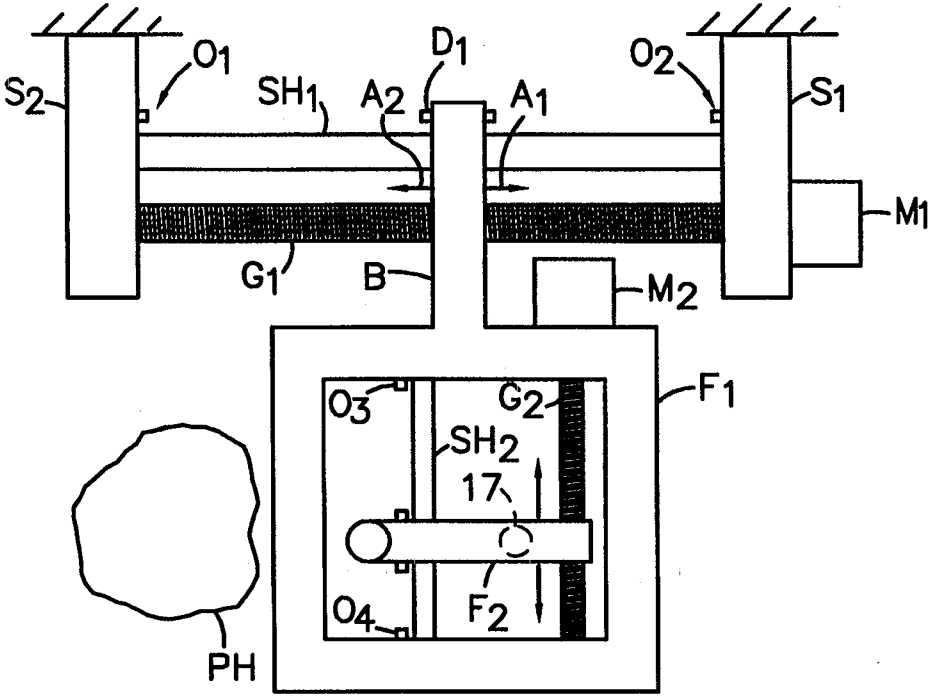
FIG. 4 is a plan view of a positioning system which may be employed in the embodiment of FIG. 1.

FIG. 4 shows an arrangement for moving a sensor 17 and/or a dispenser 20 which is comprised of a pair of supports S1, S2 supporting a fixed guide shaft SH and a worm gear G1 arranged within suitable bearings (not shown) to be freely rotatable about its longitudinal axis. A motor M1, mounted on support S1, selectively drives worm gear G1 in either a clockwise or counterclockwise direction to respectively move frame F1 either to the left or to the right as shown by arrows A1, A2, frame F1 having an integral bar B which is provided with an opening having a bushing for slidably receiving guide shaft SH and a threaded opening for threadedly engaging worm gear G1.

Frame F1 has a similar guide shaft SH2 and worm gear G2. A support frame F2 supports dispenser nozzle 20 and/or sensor 17, frame F2 being similarly provided with a bushing for slidably receiving guide shaft SH2 and a threaded opening cooperating with worm gear G2, which is driven by motor M2. Motors M1 and M2 may be driven either simultaneously or sequentially under the control of CPU 26 (see FIG. 2).

In one embodiment, the sensor 17 is positioned above a pothole as shown in FIG. 2*a*. Considering the flow diagram shown in FIG. 3*b*, sensor 17 measures the normal distance between the sensor and the road surface in the absence of any depression or pothole (or alternatively stores a manually inputted value). This distance value is stored in memory (step A1).

The sensor 17 and nozzle 20 are positioned over the pothole PH, resin or mixture is dispensed by operating pump 12 and the associated solenoid control valve 21 and distance measurements are taken at periodic intervals by sensor 17 (step B1).

The distance measurements may be taken, for example, at time intervals in the range of from 0.05 to 0.10 seconds (step B1). Each distance measurement is compared against the normal distance DN. When the difference between the distance measurement measured and the normal distance is equal to or less than a predetermined constant K, dispensing is halted (steps C, D and E). Comparison step C is continually repeated until the difference between the distance measurement and the normal distance meet the criteria of step D. The value of K greater than zero may be equal to the amount of filler material between the valve and the outlet of the nozzle when the valve is closed.

Figure 3B:
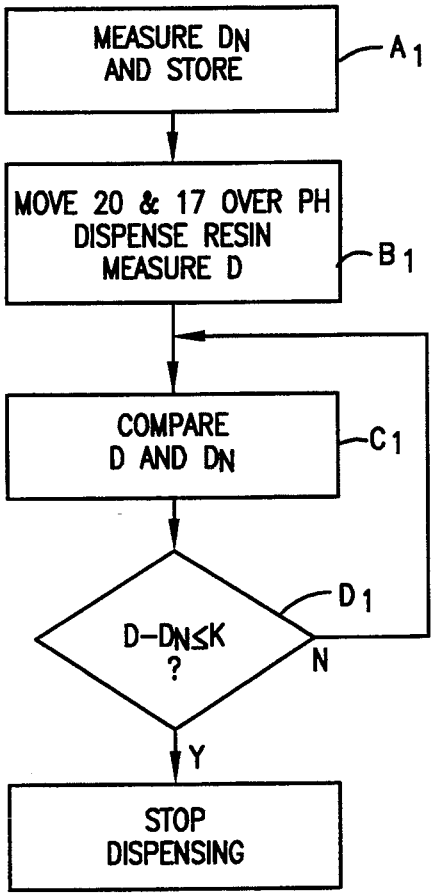
Figure 3C:
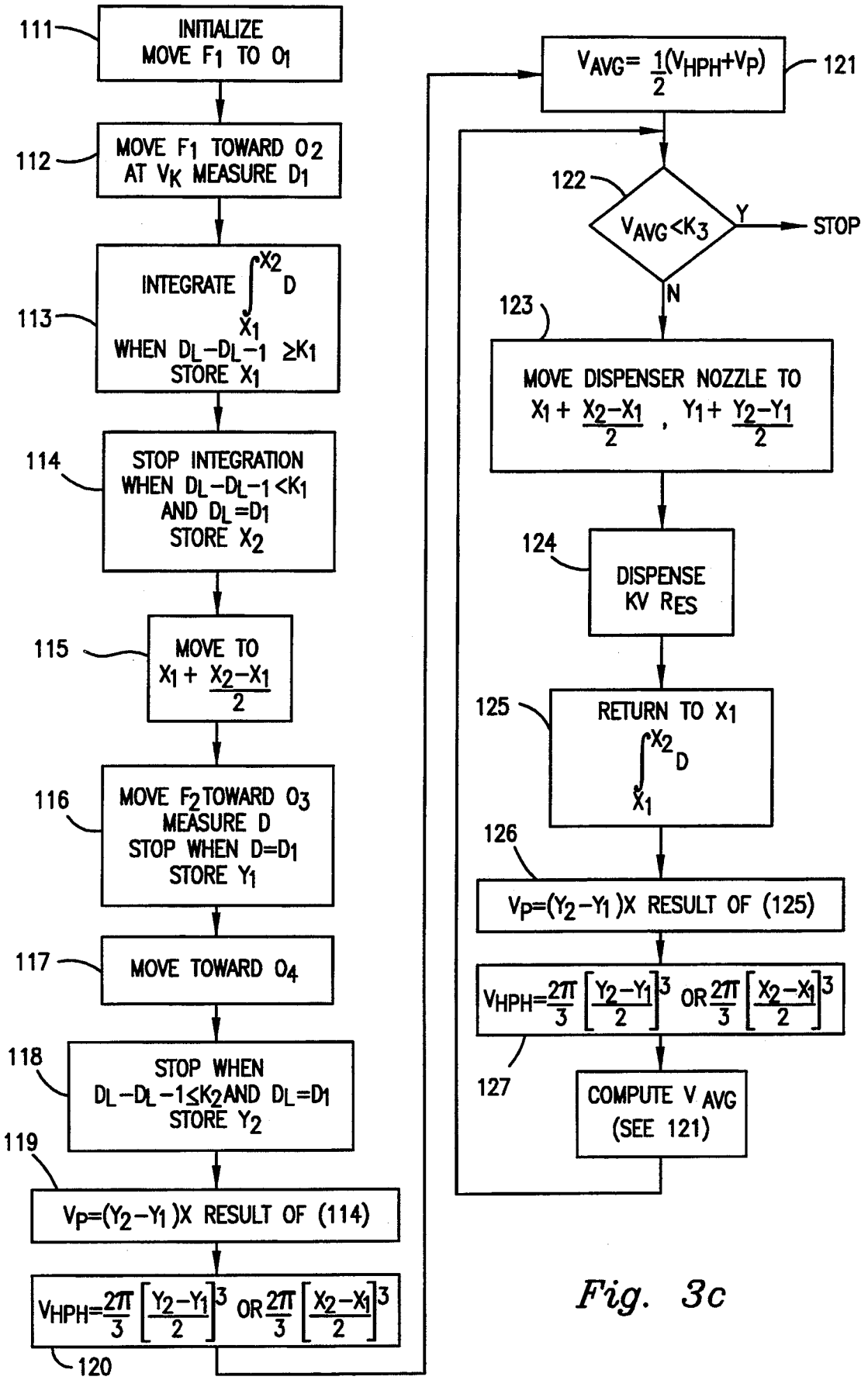

The flow diagram of FIG. 3*c* shows another technique for filling potholes and employing, for example, the positioning means shown in FIG. 4.

In step 111, the system is initialized and frame F1 is moved to point 01, a sensor or detector D1 mounted on bar B of frame F1 detects this position. At step 112, frame F1 is moved toward position 02 at a constant rate. Sensor 17 measures the distance between the sensor and the road surface. Alternatively, this value may be permanently stored since it is dependent upon the position of the sensor 17, or the value may be manually inputted by a keyboard. These values are integrated when the difference between the last value DL and DL-1 is equal to or greater than a constant K1, the position X1 is noted and stored and integration continues in this manner.

At step 114, integration is halted when the difference between the last distance measured and the next to the last distance is less than K1 and the last distance measured is equal to the normal distance D1. In addition, the position X2 is stored.

At step 115, the halfway point between X1 and X2 is calculated and the sensor is moved to this half way point. At step 116, frame F2 is moved toward 03 during which the distance D is measured. When D is equal to D1, the value Y1 is stored. At step 117, the sensor is moved toward 04 and at step 118, scanning is stopped when the last distance measured minus the next to the last distance measured is less than K2 and when the distance measured is equal to the normal distance D1. The value Y2 is then stored.

At step 119, an estimate of the volume is made by multiplying the value Y2–Y1 with the result of the integration performed at step 114. At step 120 it is further assumed that the volume is a half of a sphere and the calculation for half of a sphere is performed employing either $(X_2-X)/2$ or $(Y_2-Y_1)2$ or any average of these two values as the radius of the half-sphere. An average of the two volumes determined at steps 119 and 120 is obtained at step 121. If this average volume is less than a constant K3 (step 122), the program is halted and returned to step 111. Assuming that the average volume is greater than K3, at step 123, the dispenser is moved to the appropriate coordinate position and resin is dispensed at step 124. The amount of resin needed is a function of the volume plus a constant.

Dispensing is terminated, integration employing the coordinates X1 and X2 is performed at step 125 and the estimated volumes at step 126 and 127 are performed which are substantially the same as steps 119 and 120. The average of these volumes is determined at step 128 and this average is compared against the constant K3. These steps are repeated until the average volume is less than constant K3 which is equal to or close to zero.

If desired, steps 120, 121, 127 and 128 may be omitted and the volume calculated at step 119 may be utilized as the volume which is compared against constant K3.

Figure 5:
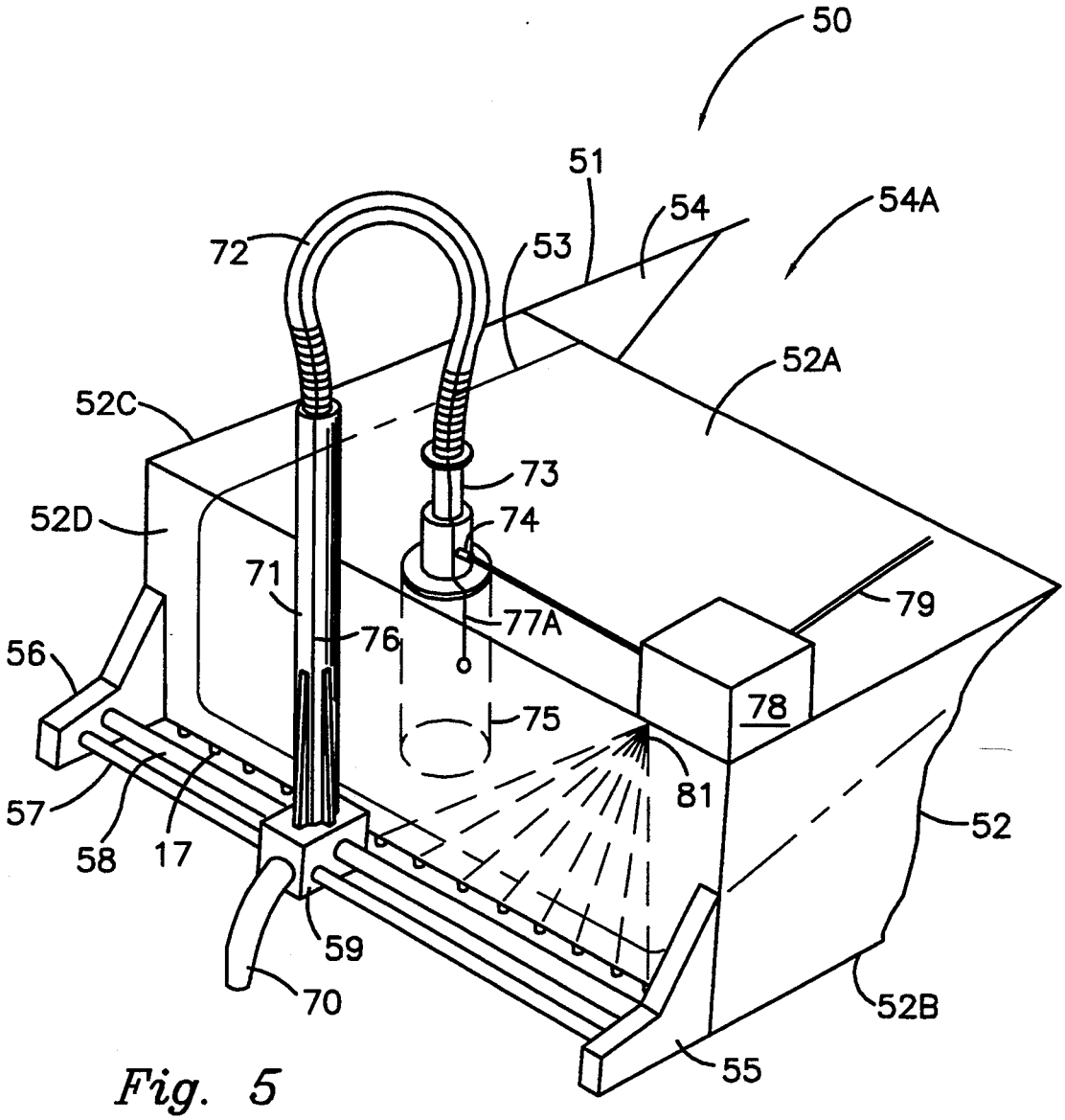
FIG. 5 is a perspective view showing still another embodiment of the present invention.
Figure 5A:
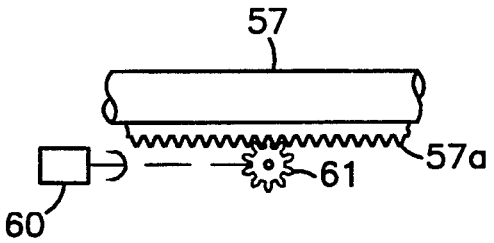
FIG. 5*a* shows a detailed view of the nozzle drive portion for the nozzle assembly employed in the embodiment of FIG. 5.
Figure 6:
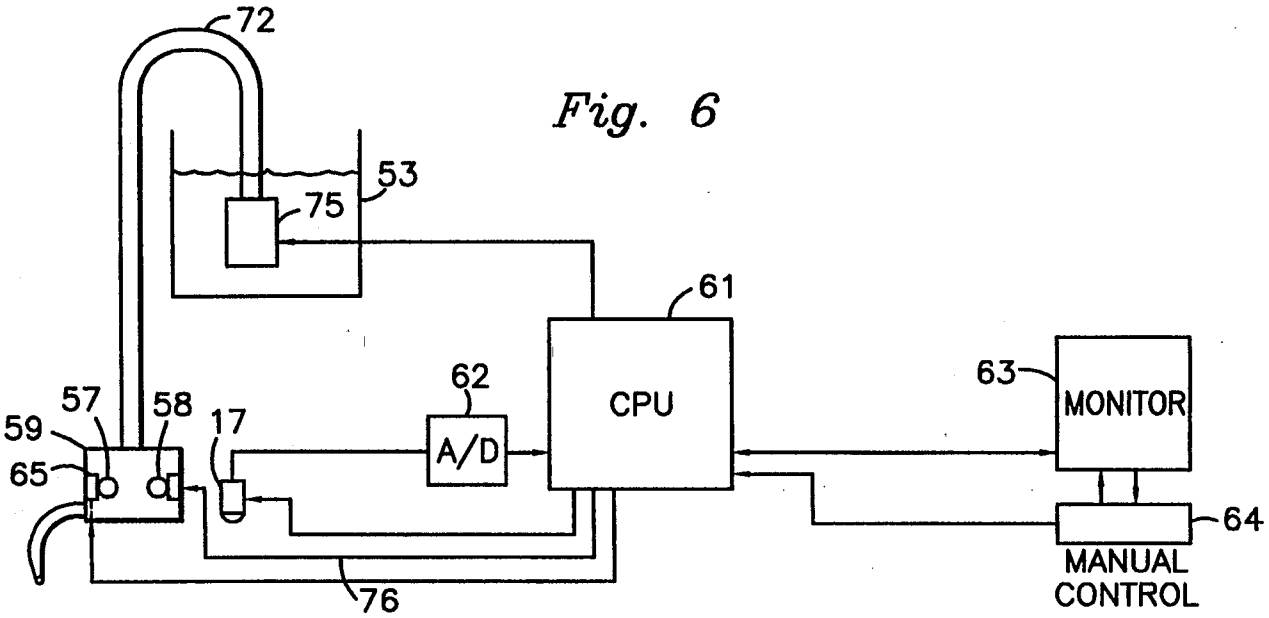
FIG. 6 shows a simplified block diagram of the control system for controlling the embodiment of FIG. 5.

FIGS. 5, 5*a* and 6 show still another embodiment 50 of the present invention which, like the embodiment 10, the apparatus may be either self-propelled, towed or pushed by a wheeled, self-propelled vehicle 51 having a body 52 with vertical side walls 52*b*, 52*c* and rear end wall 52*d* mounted upon a frame (not shown) and supporting a tank or reservoir 53 for the storage of fluent or liquid filler material of any of the types described hereinabove. Opening 54 at the top of the vehicle body communicates with hopper 54A for filling the tank. A pair of brackets 55 and 56 are welded or otherwise secured to body 52 and support a pair of spaced parallel rods 57, 58 defining a trackway along which a carriage 59 is drivable by a reversible gear motor 60 having a drive gear 61 engaging the teeth of a rack 57*a* provided along the underside of shaft 57, as shown in simplified fashion in FIG. 5*a*. In a modified form, the rack and pinion drive arrangement of FIG. 5*a* may be substituted for the worm gear drive of FIG. 4, or vice versa.

Carriage 59 supports a downwardly extending dispensing nozzle 70 for delivering resin to fill cracks, potholes or the like in the road surface. The nozzle is driven into alignment with the recess or cavity to be filled either while the vehicle is stopped or is in motion.

As in the embodiment 10, a plurality of sensors 17 sense a cavity or cavities in the roadway and generate sensing signals fed to a CPU 61 by way of an A to D converter 62. CPU 61 may be arranged within housing 78 or may be remote therefrom, such as, for example, adjacent to or within the cabin of the self-propelled vehicle. Sensors 17 provide signal information for determining the location and calculating the volume of the cavity and generate coded signals which define the shapes and locations of such cavity or cavities. The data may be utilized to provide a topological-type plot which may be presented on display monitor 63. Sensors advantageous for use in mapping topology include ultrasonic pulse-echo scanners, video cameras, employed alone or together with distance sensors to detect volume, if desired.

A pump 75 provided either within or communicating with the storage tank 53 is coupled to and driven by CPU 61 through leads 77. An elongated section of corrugated flexible tubing 72 has a first end coupled to pump 75 through a fitting 73 secured to the top wall 52*a* of vehicle body 52.

The opposite end of flexible tubing 72 is coupled to the upper end of a somewhat rigid tube 71 which communicates with nozzle 70 through a conduit provided within housing 59 to dispense resin into cavities, cracks, potholes and the like aligned beneath nozzle 70. Tubing 72 is sufficiently flexible to permit carriage 59 to travel along the guide shafts 57 and 58 and between the extreme ends thereof, under control of control signals from CPU 61. Coupling 74 selectively couples the leads 77 to the electrical terminals of pump 75. The dispenser nozzle need not pass through housing 59 and alternatively may be secured to one side wall to reduce the number of curved paths traversed by the filler material.

A cable 76 containing one or more wire pairs extends from housing 59 upwardly along tube 71 to be coupled with connector 74 for the control of motor 60 by CPU 61 (this connection is shown in simplified fashion in FIG. 6). A cable 81, comprised of a plurality of wire pairs, extends from CPU 61 to the array of sensors 17.

As an alternative, two or more carriages, similar to carriage 59, may be provided to travel along a pair of guide shafts to permit the simultaneous filling of a single cavity by two nozzles or a pair of adjacent cavities or potholes. If desired, two or more nozzles may be mounted on and driven by housing 59. The signals generated by CPU 61 responsive to the scanning signals generated by sensor 17 control the motors driving each carriage to align each nozzle 70 with one or more cavities or potholes in the road surface and control pump 75 and a separate valve 65 to control the amount of filler resin introduced into the cavity.

The control techniques may be similar to those shown in FIGS. 3*a*–3*c* to obtain either volume information, as shown in the embodiment of FIG. 3*c*, or to determine when the cavity is filled in the simplified version shown in FIG. 3*b*. Alternatively, the sensors may be employed to provide a control alarm signal and/or to control the speed or stopping of the vehicle responsive to information from sensor 17 preparatory to filling a cavity, in the manner shown by the flow diagram of FIG. 3*a*. As an alternative to driving the worm gears G1 and G2, the sensors 17 within the array are selectively energized, their spacing distances being predetermined.

CPU 61, as set forth hereinabove, is coupled to monitor 63 which may preferably be arranged within the cabin of the self-propelled vehicle. Manual control means are provided to manually input information to make requests or to override operations controls by CPU 61, for example, in accordance with the software program shown in FIGS. 3*a* through 3*c*. In addition to the embodiments shown in FIGS. 1, 3 and 4, the scanner 17 may be one or an array of TV cameras scanning to sense the contours of the cavities, as well as laser, ultrasonic (pulse echo) scanners for scanning depth to determine volume.

The sensors may be fixed in the arrangement as shown in FIG. 5 or movable as shown, for example, in FIGS. 1 and 4. The sensors may scan different strip-like widths of the road to detect locations in volumes.

As a further alternative, the top surface of the filler resin may be sensed or detected to determine when a pothole is filled by means of suitable photo-electric and/or ultrasonic pulse-echo scanning and detection means.

One or a plurality of delivery nozzles may be provided and arranged in either a stationary or movable fashion. When employing a plurality of nozzles, two or more delivery nozzles may be utilized to fill a single pothole, if desired.

Figure 7B:
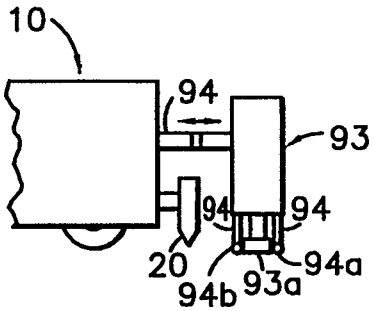
FIGS. 7*a* and 7*b* are elevational views of tamping means which may be employed with the embodiment of FIG. 1.
Figure 7A:
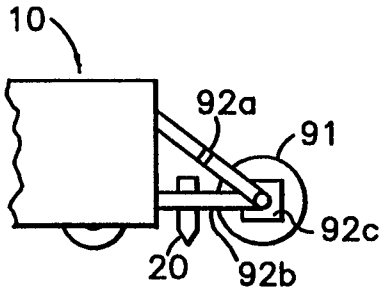

FIGS. 7*a* and 7*b* show further additions to the pothole filling assembly wherein the embodiment 10 of FIG. 1, for example, may be fitted with suitable tamping means such as, for example, a heavy roller 91 coupled to vehicle 11 by suitable supports 92*a*, 92*b* which may, for example, be driven by control signals from the CPU 26 (FIG. 2) for reversing the direction of the roller drive to reverse roller movement a number of times in order to compact the resin. Alternatively, the vehicle driving system 10 may be controlled to move the vehicle backward and forward to accomplish the tamping. Roller 91 may preferably be water filled to reduce the weight of the apparatus when being shipped between jobs. Roller 91 preferably extends the width of the system 10. As an alternative, roller 91 may be less than the width of system 10 and means 92C may be provided to move the roller laterally to roll over and hence tamp the filled cavity or pothole.

As a further alternative, FIG. 7*b* shows an arrangement in which tamping means 93 is mechanically coupled to the rear end of system 10 and may be reciprocated forwardly and rearwardly, as well as being movable laterally to place and operate a reciprocating tamping member over a filled cavity. Tamping member 93 may be suitably connected to system 10 by means 94 for holding the main tamping housing 93 a spaced distance above the road surface by way of structure 94.

Alternatively, a support frame comprised of four support members 94 (only two of which are shown in FIG. 7*b*) may each have roller members 94A for positioning tamping means 93 upon the road surface. Tamping means 93 is preferably provided with suitable pneumatic means for reciprocating a heavy tamper plate 93A to tamp asphalt or resin filling a cavity or the like under control of CPU 26, for example, as shown in FIG. 2. Tamping may be performed during and after filling, if desired.

In addition to filler and compacting means, means may be provided for curing the repair material. For example, the repair material may contain or comprise a radiation curable material, such as, a monomer or resin, and the road repair system 10 may be provided with a radiation source supported by vehicle 11 for irradiating such radiation curable material deposited within a repair cavity. The radiation source may be arranged either adjacent to or behind the filling nozzles. Noting, for example, FIG. 7*b*, the tamping means 93 may alternatively be a radiation source or may include such a source.

As another alternative, the repair material may comprise two or more constituents, each independently stored in separate tanks. The distributor means 25 may, for example, either sequentially or simultaneously dispense the constituents from each of said tanks into a common conduit which ultimately passes out of the nozzle 20 associated therewith. One of said constituents may be selected to chemically react with another one or ones of said constituents to effect curing or setting of the mixture in the pothole. Alternatively, or in addition to the chemical reaction, the tank 53, conduit 71 or housing 59, or both, may be provided with suitable heating means to either maintain the repair material in a molten state or convert the repair material to a molten state preparatory to delivery of the repair material into a pothole or other surface irregularity.

As another alternative, the tamping means 93 of FIG. 7*b* may be replaced by or have added thereto chilling means for rapidly chilling the repair material after it is dispensed. Alternatively, the repair material may be chilled just as it leaves the dispensing nozzle 20 by chilling means, such as, a blast of air surrounding the exit end of nozzle 20. An air blast and/or shock waves generated therein may be employed to tamp the material in the pothole.

Figure 8:
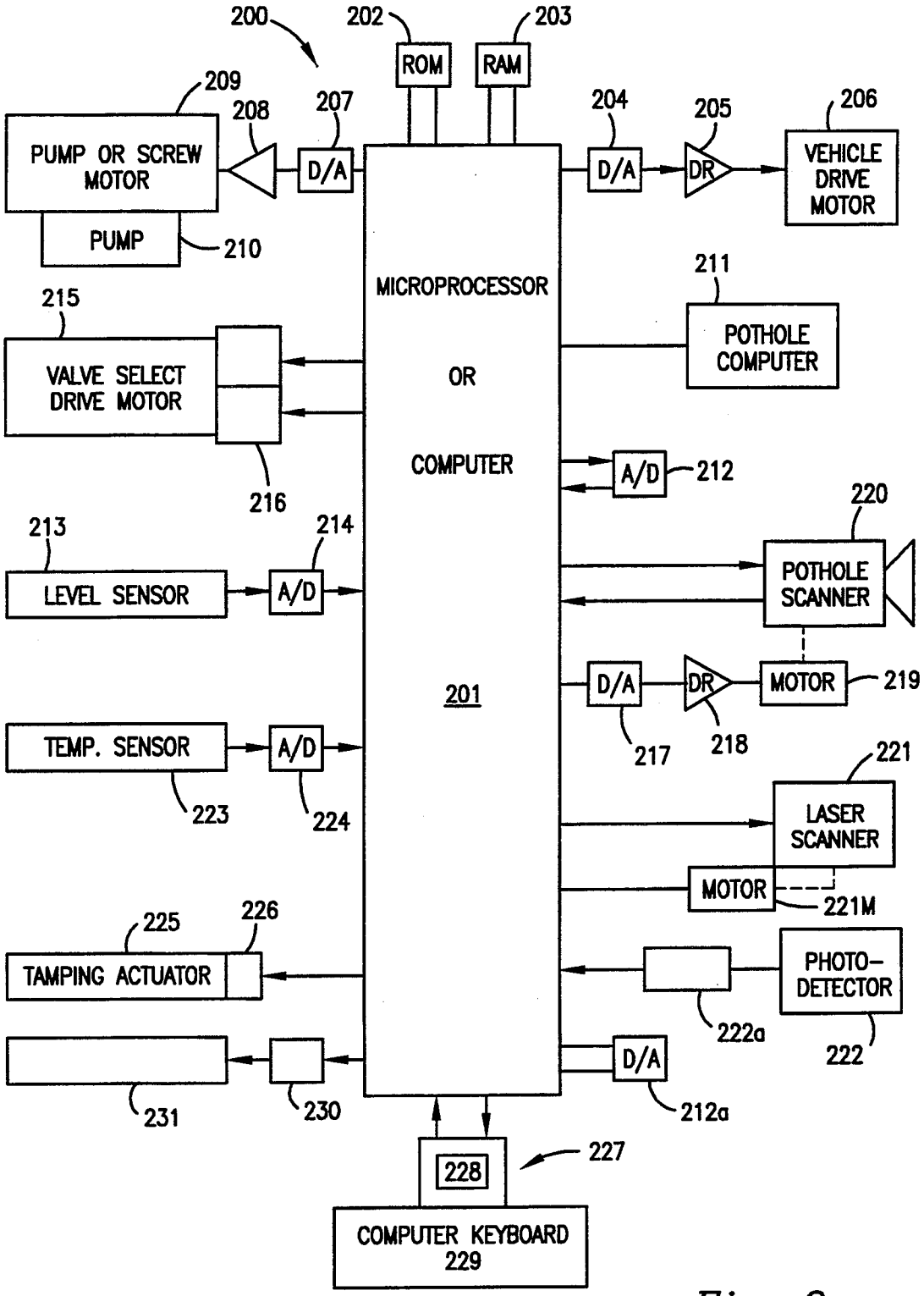
FIG. 8 shows a simplified block diagram of a general purpose control system which may be utilized to control the pothole repair system of FIG. 1, for example.
Figure 9A:
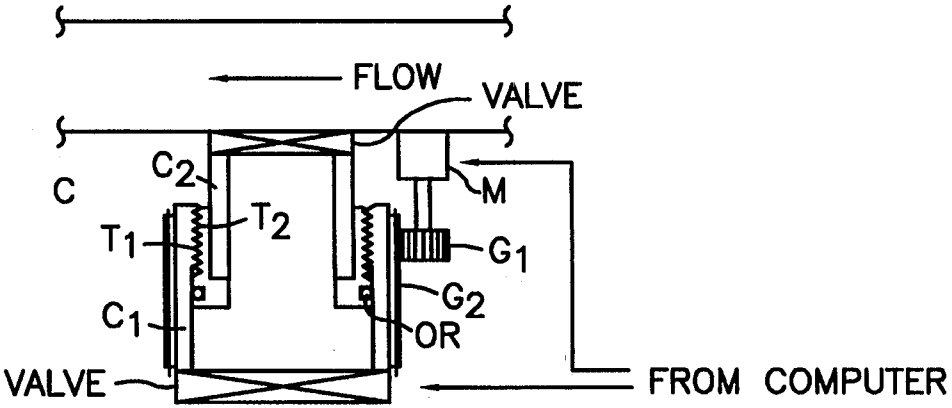

FIG. 8 shows a general purpose control system 200 for controlling the pothole filling apparatus 10 of FIG. 1, for example, to control the operation in any one of the modes described hereinabove, for example.

A microprocessor or computer 201 controls all of the peripheral devices, analyzes the scanning signals generated by sensor 17, for example, and provides control signals for controlling the operations of one or more motors, pumps, valves, and the like to control the flow and quantity of fluent resin or other filling material through one or more nozzles provided within the system, including positioning of such nozzles preparatory to dispensing asphalt, resin or the like.

Microprocessor or MPU 201 operates in conjunction with a number of memory devices including a random access memory (RAM) 203 temporarily storing and operating upon digital data such as current information relating to the operation of the apparatus or system 200. Read-only memory (ROM) 202 is utilized to store program information for controlling the operation and sequence of operations of system 200 including, for example, but not limited to, sensing cavities, detecting cavity volume, and filler level, controlling the positioning of sensors and dispensing nozzles as well as the heating and flow of filler material and tamping, compacting and curing the filler material provided within a cavity or pothole. Data recording and reproducing functions are performed when the memories are properly addressed and/or controlled by signals produced by MPU 201.

To optimize a cavity filling operation, provision is made in system 200 for variably controlling the speeds of motors driving the dispensing or driving vehicle and the other devices described above in accordance with the number of cavities per unit area of roadway to be filled as well as the volumes of such cavities and hence the amount of filling material required. For example, if the filling operation experiences a substantial increase in required flow of material due to an increase in the depth or the number of potholes directly beneath the vehicle, or, if movement of a dispenser nozzle 20 is necessary, or, if the maximum filling rate of a nozzle is insufficient to rapidly fill a cavity, the system may provide an output signal which, by way of digital-to-analog converter 204, is converted to an analog signal for regulating the vehicle drive motor 206, by way of a driver circuit 205 to slow or stop the vehicle in order to assure proper filling. If the vehicle utilizes an internal combustion engine or the like, motor 206 may be operable to variably control the combustion engine throttle, gas flow or the like, or alternatively, may be coupled with the vehicle braking system, as well as the throttle, to bring the vehicle to a halt.

In one operating mode, the location of a cavity is detected and its volume computed based upon signals outputted by a surface scanning system which may, for example, be an ultrasonic pulse-echo detection system employing common transducing means or a pair of send/receive transducers for respectively generating pulses of sound energy and receiving reflections thereof which are converted to pulsed or variable amplitude analog electric signals. These signals developed by pothole scanner 220 are analyzed by MPU 201 which develops control signals applied, for example, through digital-to-analog converter 207 and drive circuitry 208 to operate pump 210, for example, through pump or screw motor 209.

Pump 210 may be supplemented or replaced with a feed screw operating in a trough or feed cylinder terminating at the dispenser nozzle 20 (FIG. 1), for example, or a conduit connected therewith.

One or a plurality of the bank of nozzles mounted upon the vehicle may be selectively fed filler material by the distribution means 25 shown in FIG. 1 under the control of signals generated by computer 201, which further generates signals selectively applied to one or more of the solenoid control valves through control circuitry 216 and valve selector 215. For example, each nozzle may be coupled to a separate source of different filler material. The filler materials may be dispensed sequentially to provide layers of different filler material in the repaired hole. Alternatively, containers each storing a different repair material, may be sequentially coupled to one nozzle to obtain the above-mentioned layered result.

The positioning of pothole scanner 220 is controlled by computer 201 which provides control signals through digital-to-analog converter 217, drive circuitry 218 and motor 219. It should be understood that parallel digital-to-analog converter drive circuitry and motor means may be provided for controlling the driving of the scanner in mutually perpendicular directions in the manner shown, for example, in FIG. 4.

The system may be provided with a plurality of scanners either in addition to or to replace the pothole scanner 220 such as, for example, laser scanner 221 positioned by motor means 221M, photo detector 222 coupled to computer 201 through analog-to-digital converter **222*a*. Digital-to-analog and analog-to-digital converters 212 and 212*a*** may be used to convert appropriate digital and analog signals from a plurality of peripheral devices on a time-share. The laser scanner may alternatively be a TV camera. Information from the TV camera is utilized to selectively operate the control valve(s) of the appropriate dispensing nozzle(s) as well as the termination of flow of repair material.

A tamping actuator 225 is controlled by computer 201 through control circuitry 226.

Temperature and level sensors 223 and 213 may be provided to detect the level of resin in the reservoir and its temperature, at least at the dispensing point, to assure proper operation.

Valve control 230 drive circuit is employed to control valve 231 to control the heat applied to the resin container or to a heating unit in or near nozzle 20, for example.

Manual control of the computer is obtained through keyboard 229. Data and/or video display is presented on the display screen 228 of monitor 227.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A method for repairing road holes and the like utilizing a wheeled vehicle, means for containing a supply of repair material and sensing means arranged on said vehicle, said method comprising the steps of:

(a) moving said vehicle over a surface;

(b) operating said sensing means for detecting irregularities in the surface being traversed by said vehicle; and (c) dispensing repair material from said containing means responsive to the irregularities detected;

said containing means further comprising a plurality of dispensing means each having a movable outlet, said method further comprising the steps of:

moving at least two of said outlets responsive to a detected irregularity for positioning the outlets above the detected irregularity; and dispensing the same filler material from each outlet.

2. The method of claim 1 wherein step (b) further comprises the step of generating signals representative of surface irregularities; and said step (c) is performed responsive to said signals.

3. The method of claim 1 wherein the containing means further includes dispensing means having an outlet, said method further comprising the step of:

moving said outlet responsive to a detected irregularity for positioning the outlet above the detected irregularity.

4. The method of claim 1 wherein step (b) further comprises providing a video camera and further includes the steps of scanning the surface traversed by said vehicle with said video camera for generating video signals representing irregularities in said surface; and step (c) further comprises controlling the dispensing of repair material in accordance with the content of said video signals.

5. The method of claim 1 wherein step (b) further comprises providing an auxiliary scanning means and further includes the steps of:

scanning the surface traversed by said vehicle with said auxiliary scanning means for generating information signals representing irregularities in said surface; and step (c) further comprises controlling the dispensing of repair material in accordance with the information contained in the signals representing said surface irregularities.

6. The method of claim 1 wherein step (b) further comprises providing an ultrasonic scanning means and further includes the steps of:

scanning the surface traversed by said vehicle with said ultrasonic scanning means for generating information signals representing irregularities in said surface; and step (c) further comprises controlling the dispensing of repair material in accordance with the information contained in the signals representing said surface irregularities.

7. The method of claim 1 wherein step (b) further comprises providing an ultrasonic pulse-echo scanning means and further includes scanning the surface traversed by said carriage with said ultrasonic pulse-echo scanning means for generating information signals representing irregularities in said surface; and step (c) further comprises controlling the dispensing of repair material in accordance with the information defined by the signals representing said surface irregularities.

8. The method of claim 1 wherein step (b) further comprises providing a laser scanning means and further includes the steps of:

scanning the surface traversed by said carriage with said laser scanning means for generating information signals representing irregularities in said surface; and step (c) further comprises controlling the dispensing of repair material in accordance with the information contained in the signals representing said surface irregularities.

9. The method of claim 1 further comprising determining the volume of a cavity responsive to the surface irregularities detected at step (b).

10. The method of claim 1 wherein step (b) further comprises the steps of:

generating a laser beam;

detecting reflections of the laser beam from the surface being traversed by the carriage to generate information signals representative of surface irregularities; and step (c) further comprises controlling dispensing of the filler material responsive to control signals derived from said information signals.

11. A method for filling a cavity, pothole, or the like in a surface employing at least one container having repair material being mounted upon a movable wheeled carriage and dispensing means coupled to said container and having scanning devices arranged on said carriage, said method comprising the steps of:

(a) moving said carriage across said surface;

(b) employing the scanning devices for photoelectrically detecting the presence and location of a cavity in the surface being traversed and generating control signals representing the location and size of said cavity;

(c) positioning an outlet of said dispensing means above the cavity responsive to said control signals and enabling repair material from said container means to flow through said dispensing means and said outlet;

(d) Operating monitoring means for monitoring the level of repair material being dispensed into said cavity; and (e) terminating the flow of repair material responsive to a signal from the monitoring means which indicates that a level of liquid flow has reached a predetermined value.

12. A method for filling a cavity, pothole, or the like in a surface employing at least one container having a repair material being mounted upon a movable wheeled vehicle and dispensing means coupled to said container and having scanning devices arranged on said carriage, said method comprising the steps of:

(a) moving said vehicle across said surface;

(b) employing said scanning means for ultrasonically detecting the presence and location of a cavity in the surface being traversed and generating control signals representing the location and size of said cavity;

(c) positioning an outlet of said dispensing means above the detected cavity responsive to said control signals and enabling repair material from said container means to flow through said dispensing means and said outlet;

(d) operating monitoring means for monitoring the level of repair material being dispensed into said cavity; and (e) terminating the flow of repair material responsive to a signal from the monitoring means which indicates that a level of repair material in the cavity being filled has reached a predetermined value.

13. The method of claim 12 wherein step (b) further comprises the steps of:

ultrasonically detecting the presence and location of a cavity by generating pulse-echo signals;

analyzing the pulse-echo signals reflected from the surface being scanned; and step (c) further comprises controlling the position of the dispensing means outlet responsive to the pulse-echo control signals.

14. A method for filling a cavity, pothole, or the like in a surface employing at least one container of repair material being mounted upon a movable vehicle and dispensing means coupled to said container and having scanning means arranged on said vehicle, said method comprising the steps of:

(a) moving said vehicle across said surface;

(b) employing said scanning means for ultrasonically detecting the presence and location of a cavity in the surface being traversed and generating control signals representing the location and size of said cavity;

(c) positioning an outlet of said dispensing means above the detected cavity responsive to said control signals and enabling repair material from said container means to flow through said dispensing means and said outlet;

(d) Operating monitoring means for monitoring the volume of repair material being dispensed into said cavity; and (e) terminating the flow of repair material responsive to a signal from the monitoring means which indicates that a Cumulative amount of liquid flow has reached a predetermined value.

15. A method for filling a cavity, pothole, or the like in a surface employing at least one container having repair material being mounted upon a movable vehicle and having dispensing means coupled thereto and having scanning devices arranged on said vehicle, said method comprising the steps of:

(a) moving said vehicle across said surface;

(b) operating said scanning devices for electronically detecting the presence and location of a cavity in the surface being traversed and generating control signals representing the location and size of said cavity;

(c) positioning an outlet of said dispensing means above the cavity responsive to said control signals and enabling repair material from said container means to flow through said dispensing means and said outlet;

(d) operating monitoring means for monitoring the level of repair material being dispensed into said cavity; and (e) terminating the flow of repair material responsive to a signal from the monitoring means which indicates that a level of liquid flow has reached a predetermined value.

16. A method for filling cavities or the like in a road surface through the utilization of a movable wheeled vehicle, a plurality of repair material discharge devices disposed on said vehicle for discharging repair material, the material being dispensed from each device being the same material, and scanning means for scanning for cavities in the road surface, said method comprising the steps of:

(a) moving said vehicle along the road surface;

(b) operating said scanning means to scan the surface of said road and generating a signal identifying the presence of a cavity;

(c) positioning the vehicle adjacent to the detected cavity responsive to said detection signal;

(d) selectively operating at least one of said repair material discharge devices aligned with said cavity;

(e) determining when the cavity is filled with repair material; and (f) terminating the flow of repair material responsive to said cavity being filled.

17. The method of claim 16 wherein step (e) further comprises determining when the cavity is filled by determining the volume of the cavity.

18. The method of claim 16 wherein step (e) further comprises determining when the cavity is filled by determining the surface level of the repair material flowing into said cavity.

19. The method of claim 16 further comprising the step of compacting the repair material in said cavity.

20. The method of claim 19 wherein said compacting step further comprises the step of providing tamping means and operating said tamping means to compact the material in said cavity.

21. The method of claim 19 wherein said compacting step further comprises the step of providing roller means and operating said roller means to roll over said cavity.

22. The method of claim 16 further comprising the step of compacting the repair material in said cavity before and after steps (e) and (f).

23. The method of claim 16 further comprising operating chilling means for chilling the repair material placed in said cavity.

24. The method of claim 16 wherein said filler material is comprised of at least two components, said method further comprising the step of mixing said components preparatory to discharge.

25. The method of claim 16 further comprising the step of heating the repair material as it is delivered to said outlet.

26. The method of claim 16 further comprising the step of operating chilling means for chilling the repair material as it is delivered to said outlet.

27. A method for filling a cavity, pothole, or the like in a surface employing at least one container having a repair material being mounted upon a movable wheeled vehicle and dispensing means coupled to said container and having scanning devices arranged on said carriage, said method comprising the steps of:

(a) moving said vehicle across said surface;

(b) employing said scanning devices for ultrasonically detecting the presence and location of a cavity in the surface being traversed and generating control signals representing the location and size of said cavity;

(c) positioning an outlet of said dispensing means above the detected cavity responsive to said control signals and enabling repair material from said container means to flow through said dispensing means and said outlet;

(d) operating monitoring means for monitoring the level of repair material being dispensed into said cavity;

(e) generating a detecting signal when repair material reaches a predetermined level; and (f) halting flow of repair material responsive to said detecting signal.

28. A method for repairing road cavities and the like utilizing a wheeled vehicle having a plurality of outlets, each outlet having a plurality of means for containing a supply of repair material, the plurality of means for containing repair material each containing a different repair material, and sensing means arranged on said vehicle, said method comprising the steps of:

(a) moving said vehicle over a surface;

(b) operating said sensing means for detecting a cavity in the surface being traversed by said vehicle;

(c) dispensing said different repair materials into said cavity sequentially from different ones of said plurality of means for containing through said plurality of outlets in such a manner as to form layers of said different repair materials in said cavity responsive to the detection of said cavity by said sensing means.

* * * * *